United States Patent [19]

Gaudreau, Jr.

[11] Patent Number: 4,728,150

[45] Date of Patent: Mar. 1, 1988

[54] APPARATUS FOR WHEELCHAIR FITTINGS

[76] Inventor: Charles H. Gaudreau, Jr., 2736 Octavia St., New Orleans, La. 70115

[21] Appl. No.: 916,887

[22] Filed: Oct. 8, 1986

[51] Int. Cl.[4] ..... B60N 1/02

[52] U.S. Cl. ..... 297/383; 33/515; 297/284; 297/463

[58] Field of Search ..... 297/383, 463, 462, 284; D6/334; 33/515; 73/432.1

[56] References Cited

U.S. PATENT DOCUMENTS

| | | | |
|---|---|---|---|
| 1,564,339 | 12/1925 | Fraser et al. | 33/515 |
| 2,466,350 | 4/1949 | Anderson | 297/383 X |
| 2,549,902 | 4/1951 | Hibbard et al. | 297/284 |
| 2,648,910 | 8/1953 | Brown | 297/383 X |
| 2,724,592 | 11/1955 | Pfaus | 297/383 |
| 3,110,532 | 11/1963 | Nail | 297/462 X |
| 3,206,249 | 9/1965 | Gateley | 297/463 X |
| 3,374,548 | 3/1968 | Romney | 33/511 |

*Primary Examiner*—James T. McCall
*Attorney, Agent, or Firm*—Keaty & Keaty

[57] ABSTRACT

A wheelchair fitting apparatus has a laterally adjustable back section, a vertically adjustable footrest and a pair of armrests which are adjustable both vertically and laterally. A back section extender allows vertical adjusting of the back section in relation to the seat section. Suitable indicia, for example a numbered grid on the seat section, the back section and the foot rest, as well as numbered intervals on the front legs of the chair, are provided to facilitate taking of measurements of an individual. The adjustable chair is preferably made of a transparent material to allow pressure and shear, among other things, to be readily observed through the chair. The chair may be adjusted to conform to the basic dimensions of a custom wheelchair for an individual, and measurements may be easily read off of the numbered grid and the numbered intervals on the front legs. Additionally, special cushions and restraint devices may be tested with an individual sitting in the adjustable fitting chair once it has been adjusted to conform to the dimensions of a custom wheelchair for the individual.

5 Claims, 8 Drawing Figures

APPARATUS FOR WHEELCHAIR FITTINGS

BACKGROUND OF THE INVENTION

1. Field of the Invention

The present invention relates to fitting apparatus for orthotic and prosthetic devices, and more particularly to apparatus for fitting wheelchairs to persons.

2. General Background of the Invention

Wheelchairs are used by many people who, due to accident, illness or disease, have temporarily or permanently lost the use of their legs, partially or totally.

An orthosis is a brace which provides support to aid in the treatment of a physical impairment or disability. A prosthesis is a device which augments or aids performance of a natural function. A properly prescribed and fitted wheelchair is both an orthosis and a prosthesis—it provides support for an individual while increasing his mobility.

The importance of properly prescribing and fitting a wheelchair cannot be over emphasized. "The unprescribed wheelchair is potentially as harmful and as hazardous as the self-prescribed drug. It can cause trauma, secondary deformities, and disabilities and other complications which may be irreversible" (United States Department of Health, Education and Welfare, Public Health Service).

Everest and Jennings, Inc., in its booklet no. 1 *Measuring The Patient,* provides information on the basic measurements necessary when determining the dimensions of a wheelchair.

In the booklet, seat width is described as the first and most important dimension. Seat width is based on the measurement of the widest part of an individual's hips or thighs. The seat should be sufficiently wide to distribute the individual's weight over the widest possible surface while keeping the overall width of the wheelchair as narrow as possible to minimize problems with passage through halls and doorways. If the seat width is too narrow, too much pressure may be put on the ischium and trochanters, which could cause secondary problems leading to decubiti (bed sores). Also, transfer of the individual into and out of the wheelchair will be complicated. If the seat is too wide, physical and environmental problems will be presented. For example, sitting stability is limited, creating postural and other problems which could lead to complications such as scoliosis. Furthermore, doorways and public transportation could be made inaccessible if the seat is too wide.

Another basic dimension is seat depth. Seat depth is based on the measurement of the distance from the most posterior part of the buttocks to the back of the knee. Proper seat depth will cause the individual's weight to be distributed along the buttocks and thighs. If the seat is not deep enough, excessive pressure is created over the ischial areas, increasing the risk of decubiti. Also, the leading edge of the seat is closer to the center of gravity, heightening the risk of the individual falling forward out of the wheelchair during normal operation of the chair. If the seat is too deep, circulation may be restricted due to pressure on the poples and the upper posterior areas of the calves, which may also cause skin irritation.

The distance from the heel to the underside of the thigh provides the basis for determining both footrest height and seat height. The footrest should be high enough to allow safe transverse of curves, thresholds and uneven surfaces. The seat should be high enough above the foot rest to allow the individual's weight to be distributed along his thighs and buttocks, but not so high above the ground or floor that the individual's knees preclude the use of standard tables. If the seat height is too low, there will be undue pressure on the ischium, along with potential problems associated therewith.

Armrest height is another basic dimension of a wheelchair, and is based on the distance from the bottom of the buttocks to the outer bend of the elbow. If the armrest is too high above the seat, use of the armrest will push up the shoulders causing muscle fatigue, prompting many individuals not to use the armrest, with the resulting loss of stability in the sitting position. If the armrest is too low, the individual may stoop or slump to rest his forearms on the armrest, which can be unduly tiring, may effect poor balance and affect breathing.

The final dimension mentioned is back height. The measurement on which to base the back height depends on the trunk control of the individual. If normal or minimal trunk support is needed, the dimension is based on the distance from the bottom of the buttocks to under the axilla, with the arms fully extended parallel to the ground. If full trunk support is needed, the dimension is based on the distance from the bottom of the buttocks to the shoulders, neck or mid-head level, depending upon the required level of support.

It has heretofore been recommended that an individual be measured, with a tape measure, for example, in a sitting position on a standard hard back chair. In this manner, the individual is in a position as closely resembling his desired position as has been heretofore possible. Being measured for a wheelchair can be a time-consuming and a sometimes painful experience for an individual, depending upon his condition. When the individual exhibits tone problems, it is usually recommended that the measurements for seat depth taken in the sitting position be augmented with measurements taken in a supine position due to the posterior tilt of the pelvis during uncorrected sitting. Generally, the individual is placed on his back on a firm surface. While one person holds the individual's legs in the optimal position (hip flexion—90%, knee flexion—90%). Another person measures the distance from the back of the buttocks to the back of the knee. Putting an individual in a supine position to take measurements can be difficult, especially if he is a large adult. Getting the individual out of the supine position maybe next to impossible.

In addition to the basic measurements mentioned by Everest and Jennings, Inc. in *Measuring The Patient,* there are other considerations which must be taken into account when prescribing a wheelchair. Some of the measurements and conditions are best noted when the individual is seated in a wheelchair having the proper basic dimensions mentioned above, which often means that the wheelchair must be made in two stages—the basic wheelchair is constructed, then special cushions and securing devices are added once the individual has tried out the basic wheelchair. This increases the time of manufacture of the wheelchair, which can be particularly disadvantageous when the individual is still growing, or when the individual's condition is changing rapidly. There are cases in which an individual's condition has changed so much between prescription and delivery that the wheelchair is obsolete before being used. Examples of factors which can best be measured or determined when an individual is seated in a wheelchair having the proper basic dimensions include body alignment, posture, pressure and shear.

In addition to the problems of accurate measurement and proper determinations of all conditions affecting the prescription of a wheelchair, many individuals are also faced with the task of convincing a third-party payer, such as an insurance company, that a custom-fitted wheelchair is not only desirable, but also necessary to prevent further complications which could necessitate hospitalization. Some insurance companies want to be assured that the custom wheelchair will in fact be advantageous; all too often this can only be shown once the wheelchair in constructed—a situation in which many individuals have no recourse other than to buy the custom wheelchair themselves, then be reimbursed by the insurance company once the company is convinced that the wheelchair is a necessity. For individuals with limited financial means, even this manner of recourse may be impossible.

SUMMARY OF THE INVENTION

The present invention provides wheelchair fitting apparatus which allows a person to be relatively quickly and easily measured for a wheelchair.

The apparatus of the present invention comprises a chair having variable seat depth, variable armrest height and spacing, and variable back height. Suitable indicia, for example a numbered grid on the seat and the back of the chair and numbered intervals on the front legs of the chair, may be provided to allow the basic measurements of the individual to be readily determined. The chair is preferably constructed of a transparent material to allow pressure and shear to be easily observed. The chair can be quickly and easily adjusted to the basic dimensions of a custom wheelchair for an individual, resulting in a number of advantages. First and perhaps foremost, the need for taking, in a supine position, the measurement on which seat depth is based may be eliminated. This is due to the fact that an individual may be manipulated to sit correctly in the chair of the present invention, and the actual seat depth may be tested for appropriateness. Also, the type of special cushions and securing devices can be easily determined with the individual sitting in the chair; the complete wheelchair can then be ordered from the manufacturer, eliminating the two-stage process of construction heretofore practiced in the industry. Furthermore, a representative of a third party payer may be brought in during the fitting process and be shown how a wheelchair having the proper basic dimensions can help the individual sit properly and avoid further complications which could cause the third party payer even more money than a custom-fitted wheelchair.

The chair may preferably be constructed such that assembly and disassembly are quick and easy to allow it to be transported in a disassembled state.

It is an object of the present invention to provide apparatus which facilitates the fitting of a wheelchair to an individual.

Another object of the present invention is to provide apparatus which can be adjusted to the basic dimensions of a custom wheelchair for an individual.

A further object of the present invention is to provide apparatus which allows the basic measurements of an individual which are necessary to determine the basic dimensions of a wheelchair to be quickly and accurately determined.

It is also an object of the present invention to provide a wheelchair fitting apparatus which allows pressure and shear to be easily observed.

BRIEF DESCRIPTION OF THE DRAWINGS

For a further understanding of the nature, objects, and advantages of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 6:
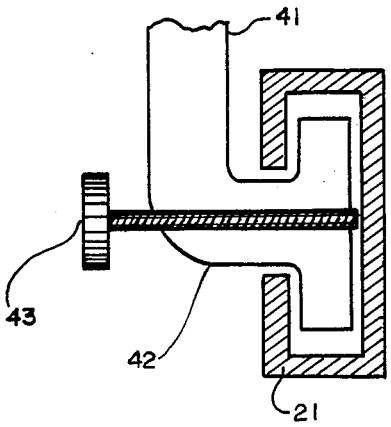
FIG. 6 is a cross-sectional, partially elevation view of an adjusting means, disposed in a grooved rail, used in accordance with the present invention.
Figure 7:
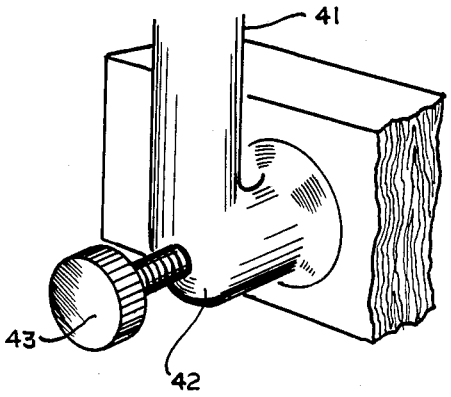
FIG. 7 is a detailed perspective view of the adjusting means shown in FIG. 6.

Referring now to the drawings, the preferred embodiment of the apparatus of the present invention comprises an adjustable fitting chair 10, various views of which are shown in FIGS. 1–4. Adjustable fitting chair 10 comprises a seat section 20, having a substantially flat upper surface, mounted on two front legs 31 and two back legs 32, a back section 40 which has a substantially flat front surface and is disposed at a substantially right angle to the upper surface of seat section 20, a footrest 60 having a substantially flat upper surface which is substantially parallel to the upper surface of seat section 20, and two armrests 51 having upper surfaces which are also substantially parallel to the upper surface of seat section 20. This relationship between the various elements of chair 10 is chosen because an individual is ideally measured for a wheelchair with his hips, knees and ankles flexed at right angles, and with his forearms parallel to his thighs. The flat surfaces approximate the actual construction of a basic wheelchair, and also facilitate the detection of pressure and shear areas. Two grooved rails 21 are disposed below seat section 20 on opposite sides thereof and slidingly receive projections 42 extending horizontally from bars 41, which are attached to back section 40. Adjusting screws 43 extend through projections 42 (FIGS. 6 and 7) and, when screwed into grooved rails 21, function to prevent projections 42 from sliding in grooved rails 21, thereby locking back section 40 in a fixed relationship with seat section 20. Grooved rail 22, also disposed below seat section 20, slidingly receives projections 54 extending horizontally from sleeve members 53, which sleeve members 53 slidingly receive vertical support bars 52 of armrest 51. Adjusting screws 56 are disposed in sleeve members 53 and, when tightened against vertical support bars 52, serve to fix the vertical displacement of armrest 51 in relation to seat section 20. Adjusting screws 55, extending through projections 54, prevent the lateral motion of armrest 51 when screwed into engagement with grooved rail 22. Projections 57 (see FIG. 3), extending vertically upward from vertical support members 52, are slidingly received in grooved rails 58 attached to the underside of armrests 51, and allow armrests 51 to slide backward and forward.

Footrest 60 is attached to two bars 61, each of which has a projection 62 extending horizontally therefrom. Projections 62 are slidingly received in grooved rails 33 attached to front legs 31. Adjusting screws 63 secure footrest 60 in a fixed vertical position relative to seat section 20 when they are screwed into engagement with grooved rails 33.

The front surface of back section 40 and the upper surfaces of seat section 20 and footrest 60 are provided with a grid, and front legs 31 are provided with numbered intervals, to facilitate the determination of measurements of an individual. The grid may be numbered, lettered and/or color-coded to further reduce the time required to take the basic measurements.

Seat section 20, back section 40, and footrest 60 of adjustable fitting chair 10 are preferably made of a transparent material to allow pressure and shear to be readily observed through the chair; the material should be strong and non-brittle as well. An example of a material having these properties is the clear plastic sold under the trademark Tuffak.

Chair 10 is constructed such that all projections may slide out of their respective grooves to allow disassembly of the chair 10 to facilitate transportation thereof.

Figure 1:
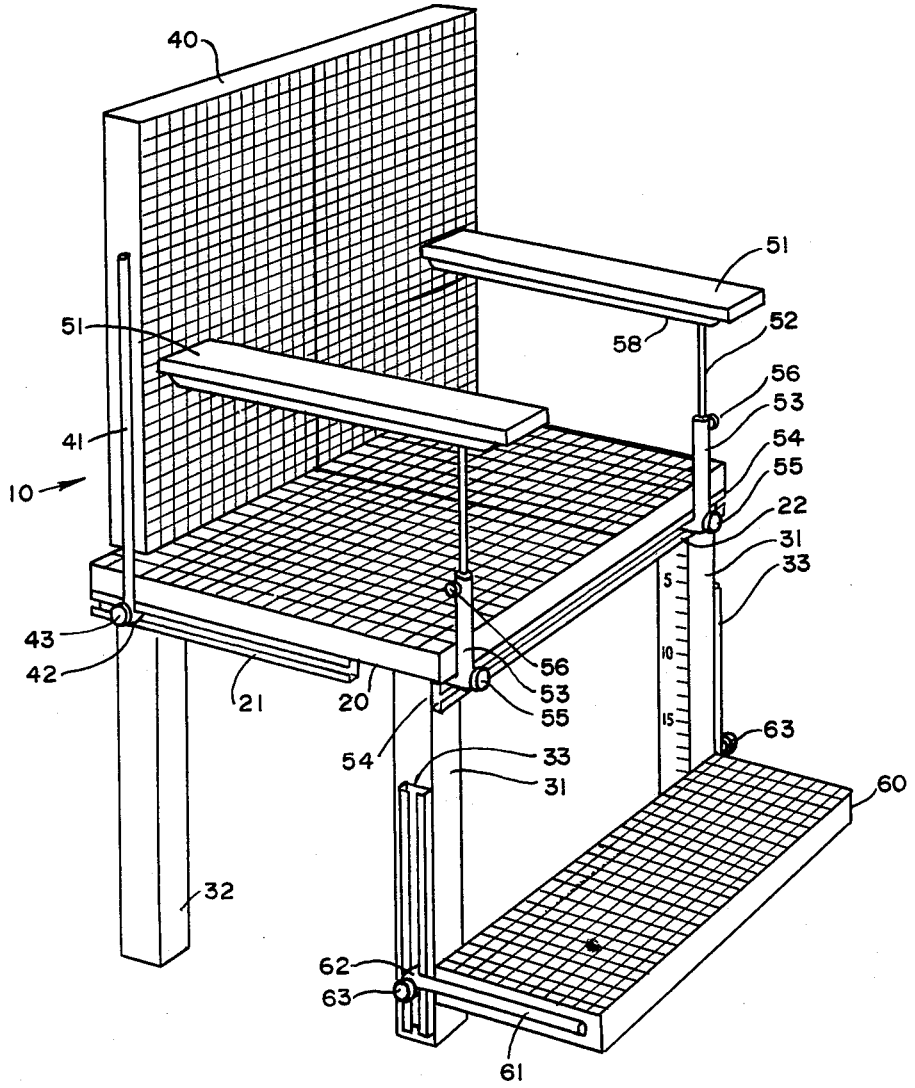
FIG. 1 is a perspective view of the preferred embodiment of the apparatus of the present invention.
Figure 2:
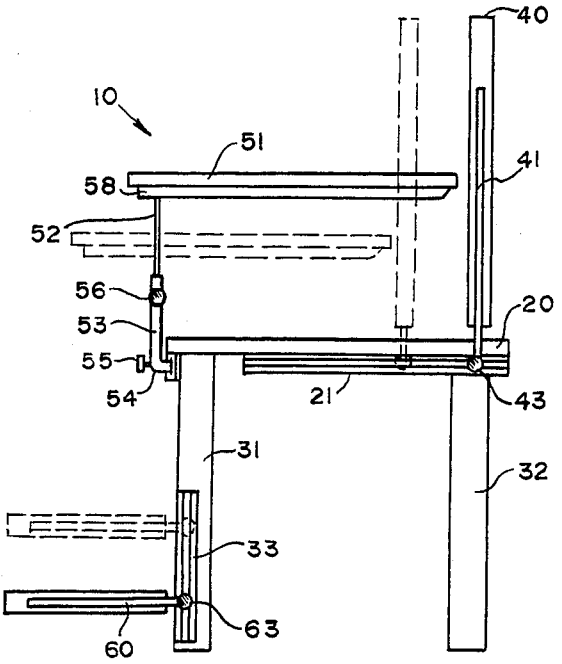
FIG. 2 is a side elevational view of the apparatus shown in FIG. 1.
Figure 3:
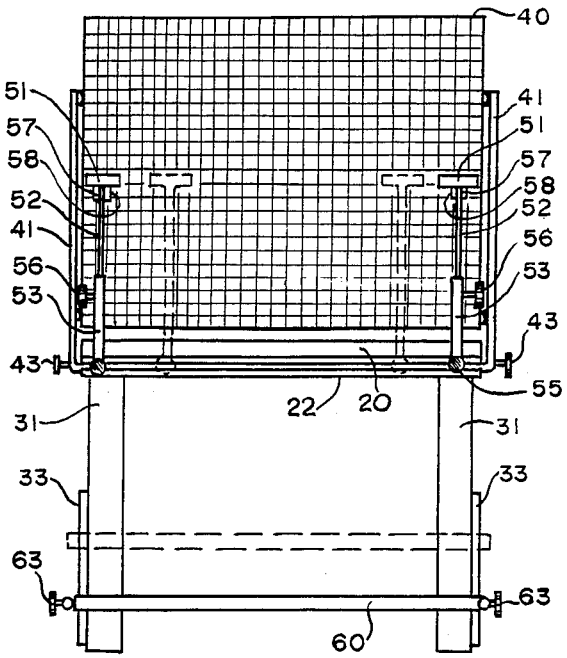
FIG. 3 is a front elevational view of the apparatus shown in FIG. 1.
Figure 5:
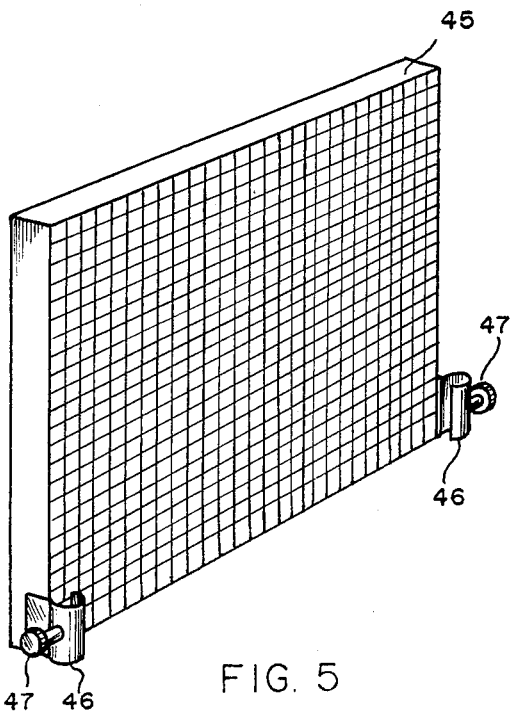
FIG. 5 is a perspective view of a back extender of the apparatus of the present invention.
Figure 4:
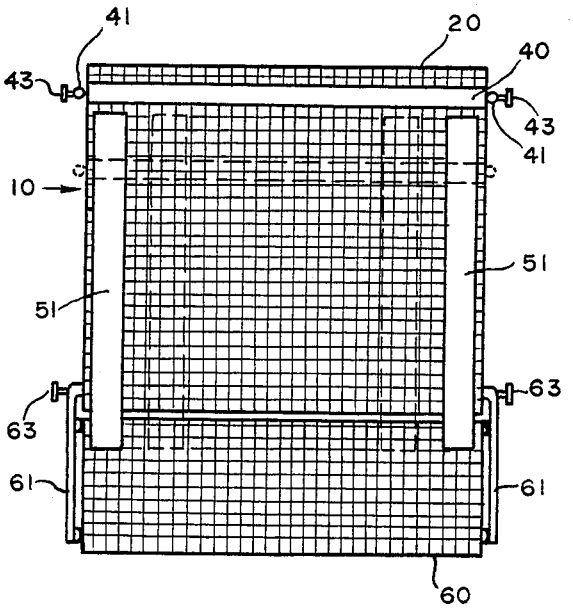
FIG. 4 is a top view of the apparatus shown in FIG. 1.

A number of back sections 40 of varying heights could be provided, in which case a back section 40 of the appropriate height would be selected when fitting a wheelchair to an individual. When there is little danger that an individual will go into extension during the fitting process, a short back section 40 with an adjustable extender 45 (see FIG. 5) could be used. Adjustable extender 45 has a pair of open sleeve members 46 which are slidingly received on bars 41 of back section 40. Adjusting screws 47 screw into contact with bars 41 to fix the vertical position of adjustable extender 45 relative to seat section 20. A grid similar to that of back section 40 is provided on adjustable extender 45.

Figure 8:
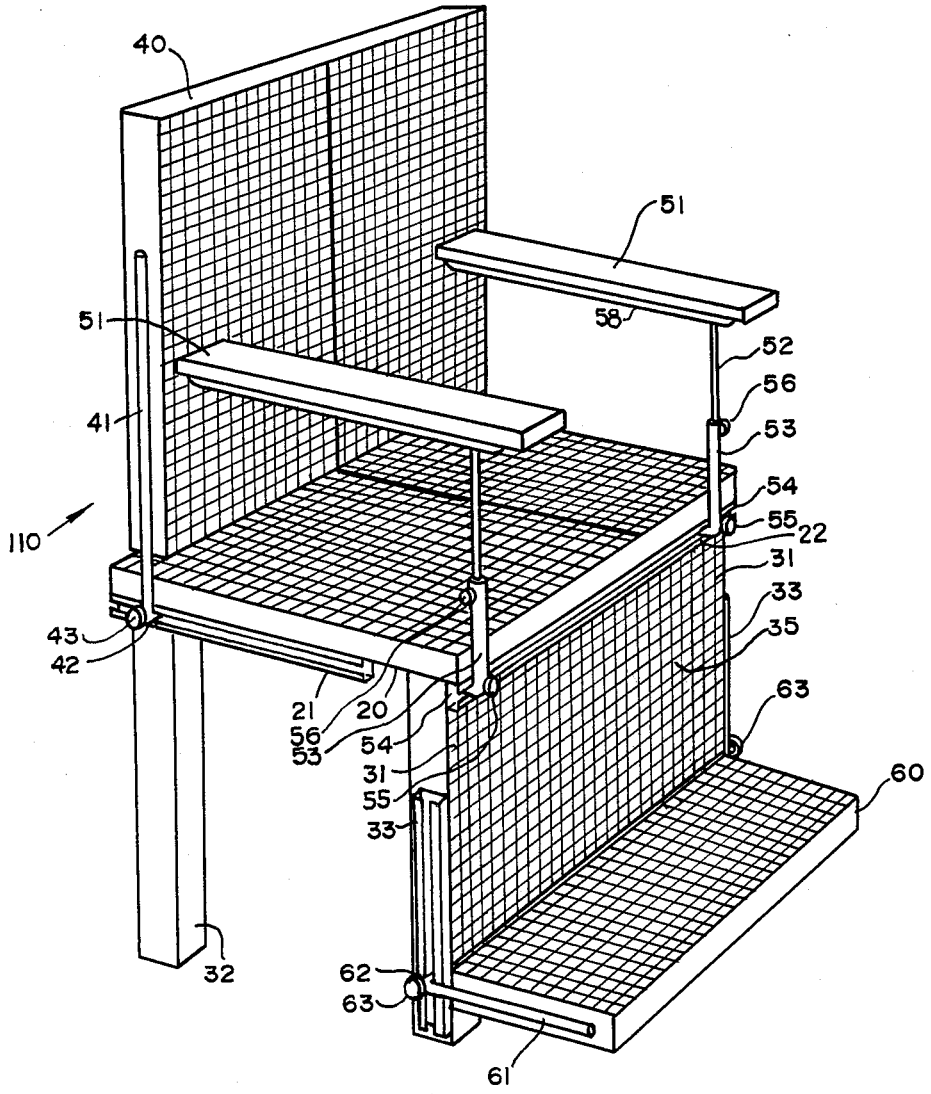
FIG. 8 is a perspective view of an alternate embodiment of the present invention.

An alternate embodiment of the present invention, adjustable fitting chair 110, can be seen in FIG. 8. Adjustable fitting chair 110 is similar in design and purpose to adjustable fitting chair 10, and like reference numerals denote like elements. Adjustable fitting chair 110 differs from adjustable fitting chair 10 in that a rectangular leg-length section 35 replaces the front legs 31 of adjustable fitting chair 10. Leg-length section 35 allows leg-length discrepancies and leg alignment discrepancies of an individual to be readily observed and measured, and comprises a grid similar to that on back section 40, seat section 20, and footrest 60.

When a wheelchair is to be fitted to an individual, the individual may go to a clinic in order to have this done or, more conveniently for the individual, a fitter may go to the individual's location. In the former case, adjustable fitting chair 10 of the present invention may be pre-assembled. In the latter case, the wheelchair fitter would transport adjustable fitting chair 10 in a disassembled state, and assemble it at the individual's home or in his hospital room. A back section 40 having the proper height for the individual (determined by measurement or trial-and-error) may be used when assembling chair 10 or, preferably, adjustable extender 45 could be used in conjunction with a back section 40 having a relatively low height if there is little danger that the individual will go into extension while being fitted. Chair 10 is preferably warmed, as with a portable hair dryer, prior to measurement, since the individual is ideally measured wearing as few clothes as possible, to allow all measurements and observations to be as accurate as possible. The individual may be measured while sitting directly on the chair or, if he will be using cushions on his wheelchair, while seated on cushions, such as inflatable plastic cushions (not shown) which are transparent to allow measurements to be read therethrough. With the individual seated in chair 10, chair 10 may be adjusted to provide the proper seat width, seat depth, seat height, arm rest height and back height for the individual. The first four of these dimensions are maintained by tightening adjusting screws 55, 43, 63 and 56, respectively. The fifth dimension is maintained by either selecting a back section 40 having the proper height for the individual, or by tightening adjusting screws 47 of adjustable extender 45. The basic dimensions may then be read off of the grid on back section 40 (and, if applicable, adjustable extender 45) and seat section 20, and off of the numbered intervals of front legs 31. The placement of the individual's feet on the numbered grid on the upper surface of foot rest 60 can be observed to determine what, if any, type of corrective foot rest may need to be provided on his wheelchair. If the individual has special leg conditions, such as leg-length discrepancies or problems aligning his legs, adjustable fitting chair 110 should be used instead of adjustable fitting chair 10 to aid in measuring under these special conditions.

The individual, while seated on the adjustable fitting chair, may be photographed in various views to aid the manufacturer while constructing the wheelchair. X-rays may be taken through the chair to determine, for example, the extent of spinal curvature of the individual. Since the individual may be manipulated to sit correctly in the adjustable fitting chair, and the seat depth can be adjusted by moving back section 40, the need for taking measurements in a supine position can, in many cases, be eliminated and, with it, the time and trouble associated therewith. This is particularly advantageous when measuring a large individual. The types of special cushions and securing and restraint devices needed can be determined with the individual sitting in the chair. If cushions are being used, they may be removed to allow the location of pressure and shear to be observed directly through the chair, and the wheelchair can be designed taking shear and pressure into account.

It can be seen, then, that using the adjustable fitting chair of the present invention during the fitting process allows the fitter to order a complete wheelchair, thereby obviating the two-stage process of fitting and construction which is prevalent in the industry today.

When dealing with a sometimes reluctant third-party payer, such as an insurance company, a representative of the third-party payer may be invited to observe the fitting process. The fitter can then demonstrate the difference in the individual's posture when sitting in a custom-fitted chair as compared to sitting in a wheelchair having standard dimensions, and explain what long term disorders may be avoided by using a custom-fitted wheelchair. Also, the fitter may show the representative how certain special features, such as restraint devices, may be beneficial for the individual, and explain how the absence of such devices may have negative effects on the health of the individual, which could lead to surgery or hospitalization (at an expense to the third-party payer of many times the cost of the custom-fitted, custom-equipped wheelchair).

It can thus be seen that the adjustable fitting chair of the present invention can benefit an individual by reducing the time required to take his basic measurements for a wheelchair, by (in many cases) eliminating the need for taking measurements in a supine position, by reducing the two-stage process of wheelchair fitting to a one-stage process, and by providing a means to convince a third-party payer of the benefits of a custom-fitted, custom-equipped wheelchair before the manufacture thereof.

While only two embodiments of the present invention have been described, there are numerous modifications which could be made thereto without departing from the spirit or scope of the present invention. Also, while only a limited number of benefits derived by the use of the adjustable fitting chair of the present invention have been mentioned, there are many others which will be apparent to those of ordinary skill in the art. I therefore pray that my rights to the present invention be limited only by the following claims.

I claim:

1. An adjustable chair for fitting a wheelchair to an individual, said adjustable chair comprising:

a seat section having an upper surface and a front edge;

a back section having a front surface which is disposed substantially perpendicularly to the upper surface of the seat section, wherein said seat section and said back section are transparent; and means for laterally adjusting distance from the front surface of the back section to the front edge of the seat section while retaining the substantially perpendicular relationship between the front surface and the back section and the upper surface of the seat section.

2. An adjustable chair for fitting a wheelchair to an individual, said adjustable chair comprising:

a seat section having an upper surface and a front edge;

a back section having a front surface which is disposed substantially perpendicularly to the upper surface of the seat section;

an adjustable extender, having a top edge, adapted for attachment to said back section, and means for vertically adjusting distance from the top edge of the adjustable extender to the upper surface of said seat section; and means for laterally adjusting distance from the front surface of the back section to the front edge of the seat section while retaining the substantially perpendicular relationship between the front surface of the back section and the upper surface of the seat section.

3. An adjustable chair for fitting a wheelchair to an individual, said adjustable chair comprising:

a transparent back section having a front surface;

a transparent seat section having a front edge and an upper surface;

two laterally spaced apart armrests, each armrest having an upper surface which is substantially parallel to the upper surface of said seat section;

a footrest having an upper surface which is substantially parallel to the upper surface of said seat section;

means for laterally moving the back section relative to the front edge of the seat section;

means for adjusting lateral spacing between said two armrests;

means for vertical adjustment of the two armrests in relation to the upper surface of said seat section; and means for vertical adjustment of the footrest in relation to the upper surface of said seat section.

4. The adjustable chair of claim 3, further comprising indicia to facilitate taking measurements of an individual.

5. The adjustable chair of claim 4, wherein said indicia comprises a numbered grid.

* * * * *